US007056126B2

(12) United States Patent
Gehlert et al.

(10) Patent No.: US 7,056,126 B2
(45) Date of Patent: Jun. 6, 2006

(54) CONTACT ARRANGEMENT AND USE THEREOF

(75) Inventors: Bernd Gehlert, Bruchköbel (DE); Rolf Paulsen, Hanau (DE)

(73) Assignee: W. C. Heraeus GmbH, Hanau (DE)

( * ) Notice: Subject to any disclaimer, the term of this patent is extended or adjusted under 35 U.S.C. 154(b) by 0 days.

(21) Appl. No.: 11/078,156

(22) Filed: Mar. 11, 2005

(65) Prior Publication Data

US 2005/0202688 A1 Sep. 15, 2005

(30) Foreign Application Priority Data

Mar. 15, 2004 (DE) ..... 10 2004 012 777

(51) Int. Cl.
*H01R 39/00* (2006.01)

(52) U.S. Cl. ..... 439/13

(58) Field of Classification Search ..... 439/13, 439/17, 107; 200/51.12, 438, 276, 246, 532, 200/531, 6 R; 174/66
See application file for complete search history.

(56) References Cited

U.S. PATENT DOCUMENTS

| | | | | |
|---|---|---|---|---|
| 2,429,222 | A * | 10/1947 | Ehrhardt et al. | 205/138 |
| 3,949,181 | A | 4/1976 | Kempf | |
| 5,260,534 | A * | 11/1993 | Chung | 200/553 |

FOREIGN PATENT DOCUMENTS

| | | | |
|---|---|---|---|
| DE | 24 34 272 | A1 | 2/1976 |
| DE | 81 19 081.6 | U1 | 10/1981 |
| DE | 83 10 658.8 | U1 | 9/1983 |
| DE | 228 928 | A1 | 10/1985 |
| DE | 34 28 411 | A1 | 2/1986 |
| DE | 42 31 079 | C2 | 9/1994 |
| DE | 195 30 512 | C1 | 10/1996 |
| DE | 197 14 522 | C1 | 5/1998 |
| DE | 102 14 973 | C1 | 8/2003 |
| FR | 2 793 067 | A1 | 11/2000 |

* cited by examiner

*Primary Examiner*—Alexander Gilman
(74) *Attorney, Agent, or Firm*—Akin Gump Strauss Hauer & Feld, LLP

(57) ABSTRACT

A contact body, especially for switching contacts, has a substrate and a contact layer. The substrate is formed as a wire and the contact layer is arranged directly on the wire.

18 Claims, 7 Drawing Sheets

CONTACT ARRANGEMENT AND USE THEREOF

BACKGROUND OF THE INVENTION

The invention relates to a contact arrangement having at least one contact body with a substrate and a contact layer, and having at least one counter contact body, wherein the substrate is formed as a wire, the contact layer is arranged directly on the wire, and the at least one counter contact bodies is formed as a wire. The invention further relates to the use of the contact arrangement.

Previously known contact bodies are described, for example, in "Albert-Keil Contact Seminar 2003," Karlsruhe, pages 21ff (electromechanical switching elements for high-frequency applications). Such contact arrangements comprise structured metal sheets, which carry contact materials soldered or welded onto their surface. Contact layers are known from German Patent DE 102 14 973 C1. German Patent DD 228 928 A1 discloses a contact arrangement, in which a contact piece formed from a wrapped wire is arranged on a contact body. In German Utility Model DE 81 19 081 U1, a contact arrangement is disclosed comprising a wire-shaped contact and a similarly wire-shaped counter contact. Both wires are fused into an insulating plate, such that they form contact pins on the side of the insulating plate facing away from the spring contact. An additional limit is provided for limiting the motion of the longer contact wire. German Patent DE 195 30 512 C1 discloses an electric layer contact in the form of a coated wire. This wire is welded to a contact carrier in sections. From German Patent DE 42 31 079 C2, contact springs for weak-current applications are known, for which a contact material is applied onto a carrier strip in sections. German published patent application DE 34 28 411 A1 discloses a molded contact sheet, onto which contact wires are welded in sections. The sheet is provided with bends and stamping. Due to the spring-like property of the sheet, it is used as a contact rocker. German Patent DE 197 14 522 C1 discloses so-called slide contacts, for which the stationary part is formed as a wire contact.

BRIEF SUMMARY OF THE INVENTION

The invention is based on the object of improving the known contact arrangements with the goal of enabling further miniaturization.

According to the invention, with a contact arrangement as described at the outset, the contact body is preferably arranged on a base body by means of a rocker arranged so that it can move on a bearing. In another embodiment of the invention, the contact arrangement has two counter contact bodies.

By the use of a wire, greater miniaturization can be realized relative to conventional sheets, and the fabrication is significantly simpler, because shaping processes can be eliminated to the greatest possible extent or can be embodied more simply than for the shaping of structured thin sheets. The arrangement of a contact layer directly on a wire, especially by roll-bonded cladding, electroplating, or sputtering, guarantees high contact reliability and a large contact surface relative to welded contacts, so that the current transfer is improved. Advantageously, the wire is formed as a wrapped wire. The wire is preferably formed as spring wire. The wire or the jacket can be formed from a cold-hammered metal or a metal alloy, for example, of a copper alloy or stainless steel. The jacket can be formed of a noble metal alloy. The contact layer preferably has a gold alloy and/or a ruthenium alloy, especially gold, and at least one metal selected from the group including ruthenium, tungsten, cobalt, and nickel.

In addition to the high degree of possible miniaturization, the arrangements according to the invention have the advantage that counter contact bodies and contact bodies can be formed from the same wire, which significantly simplifies production. Relative to the known contact arrangements with riveted, welded, or soldered contact pieces, an advantage of the invention is that, among other things, a wire coated with contact material is suitable for application in the high-frequency range, for example for transmitting antenna signals, because it does not produce undesired signal reflections at junctions of a contact piece with the contact body.

The fabrication of the arrangements is significantly simplified and made inexpensive by reducing the necessary number of tools. For this purpose, it is preferred that the counter contact body be formed from the same material as the contact body, that the wire be formed as a wrapped wire, and that it features spring-like properties. The contact layer can be roll-bonded, sputtered, or electroplated. Advantageously, the contact body comprises several wires, preferably about two to twenty wires, which are arranged parallel to each other. The counter contact body is preferably arranged stationary to the bearing and preferably on the base body. The rocker can be formed of plastic, wherein the plastic encloses the wires of the contact body over a portion of its length, preferably in the central region. The rocker can also be formed as a wire, especially from the same material as the contact body and counter contact body.

The contacting of the contact body is preferably realized in the central region of the rocker, wherein an electric conductor, the so-called "intermediate contact," is connected there to the contact body. In the case of the formation of the rocker as a wire, this part itself can represent the supply line.

An advantageous configuration of the second embodiment of the invention is characterized by the contact body being arranged so that it can shift in parallel and has approximately the same spacing to two counter contact bodies. This formation as a bridge contact, for which the contact body moves, for example up and down, has the advantage of higher insulation stress resistance in the opened state, conditional upon greater air gaps for the same structural size. Advantageously, such an arrangement can also be formed as a change-over switch, in which counter contact bodies, which each limit the possible motion of the contact body, are arranged on both sides of the contact body (thus, for example both underneath and also above). Therefore, upon opening one contact pair, another contact pair is closed.

The wire of the at least one counter contact body can also be replaced by a sheet, which is preferably stamped and on which a contact material is preferably arranged.

It has been shown that contact arrangements according to the invention are very well suited to use in high-frequency switching devices.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
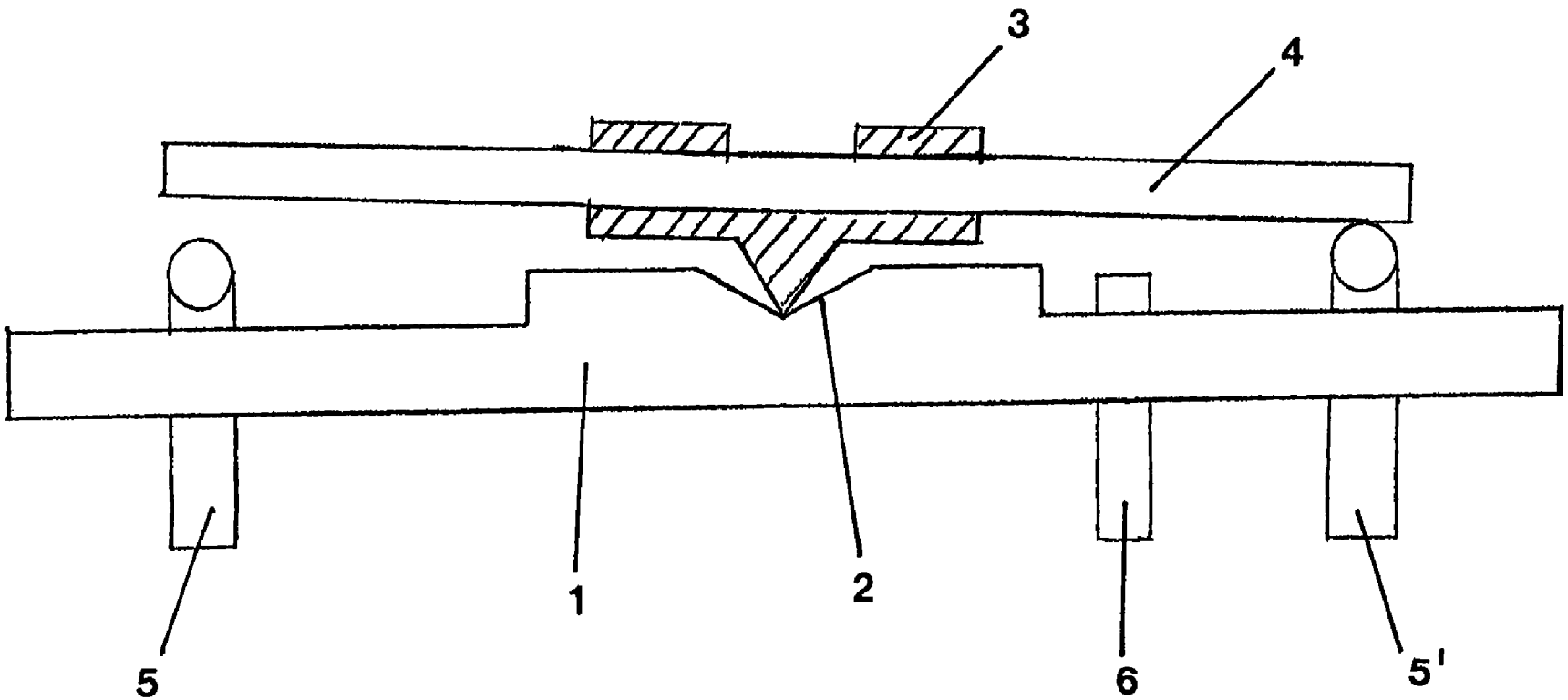
FIG. 1 is schematic side view of a contact arrangement according to a first embodiment of the invention.

The contact arrangement shown in FIG. 1 has a base body 1 made of an electrically insulating material. The base body 1 has in its central region a notch (bearing) 2, in which the rocker 3 is supported with an edge formed by a tip on its underside. The rocker 3 is made of plastic, in which several contact bodies 4 are cast. In the base body 1 two counter contact bodies 5; 5' are formed, either cast or mounted in a through hole of the base body 1. In addition, an intermediate contact 6 is arranged in the base body 1. The intermediate contact 6 is connected electrically, e.g., by a bonded wire (not shown in the Figure for reasons of clarity), to the contact bodies 4 in their central portion located in the region of the rocker 3. The counter contact body 5 is here shown as a so-called "closer contact," while the counter contact body 5' forms the so-called "opener contact."

Figure 1A:
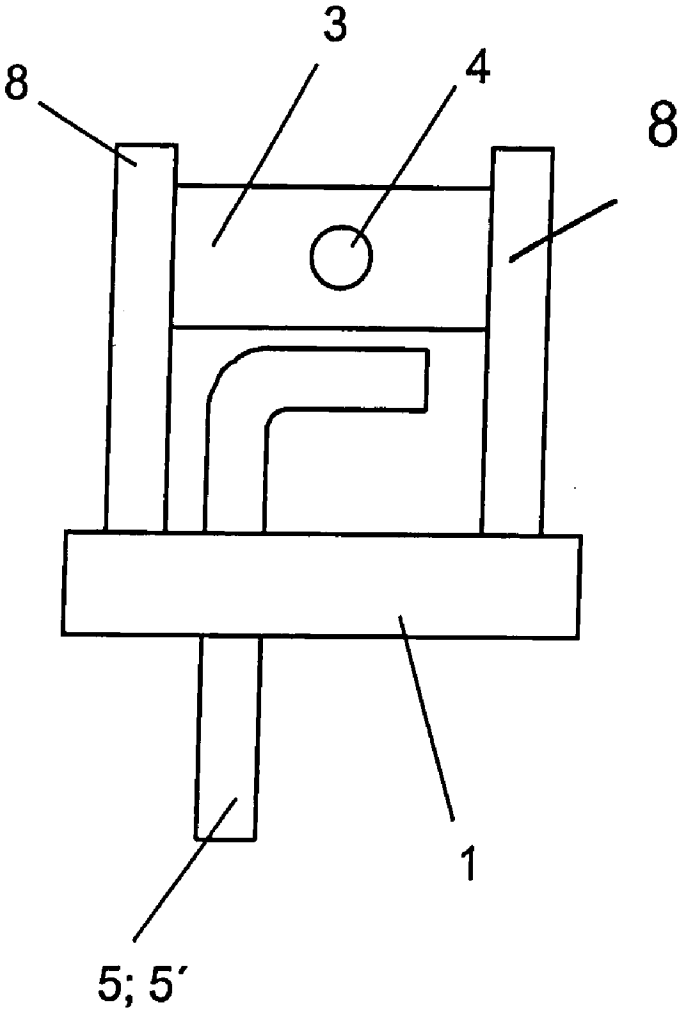
FIG. 1*a* is a schematic end view of the arrangement according to the first embodiment.

In FIG. 1*a* the arrangement of the counter contact bodies 5; 5' is shown relative to a contact body 4. The rocker 3 is guided by guide elements 8, which hold the rocker 3 in its place in the notch 2 and simultaneously enables the necessary motion. In the case of several contact bodies, these are arranged next to each other parallel to the horizontal upper side of the counter contact bodies 5; 5'.

Both the contact bodies 4 and also the counter contact bodies 5; 5' are formed from the same wire. Likewise, the intermediate contact 6 can be produced from the same wire. The wire can be, for example, a wrapped wire. The wire can be formed, for example, from stainless steel or a copper alloy and cold-hammered. The contact layer can be formed from known contact materials, for example, from a layer structure of a nickel base layer with a gold-cobalt layer arranged thereon (for example by electroplating of the contact layer) or from a base layer made of ruthenium/tungsten and a contact layer made of gold or a gold-nickel alloy (for example application of the layer by PVD (physical vapor deposition) processing). The wrapped wire can also be manufactured by roll-bond cladding.

The wrapped wire can have a diameter of about 50 to 200 μm, according to the use of the contact arrangement, with a layer thickness of the contact layer of about 0.1 to 50 μm, according to the application. The wire can basically also be formed with an elliptical cross section, wherein the contact layer is applied on only part of the periphery of the wire (for example by sputtering). A longitudinal rib-shaped profile of the wire is also conceivable. Here, the wire forms several contact points with its counter contact and thus increases the contact reliability. The rocker, and thus the motion of the contact bodies 4, is driven, for example, by a relay coil in a known manner.

Figure 2:
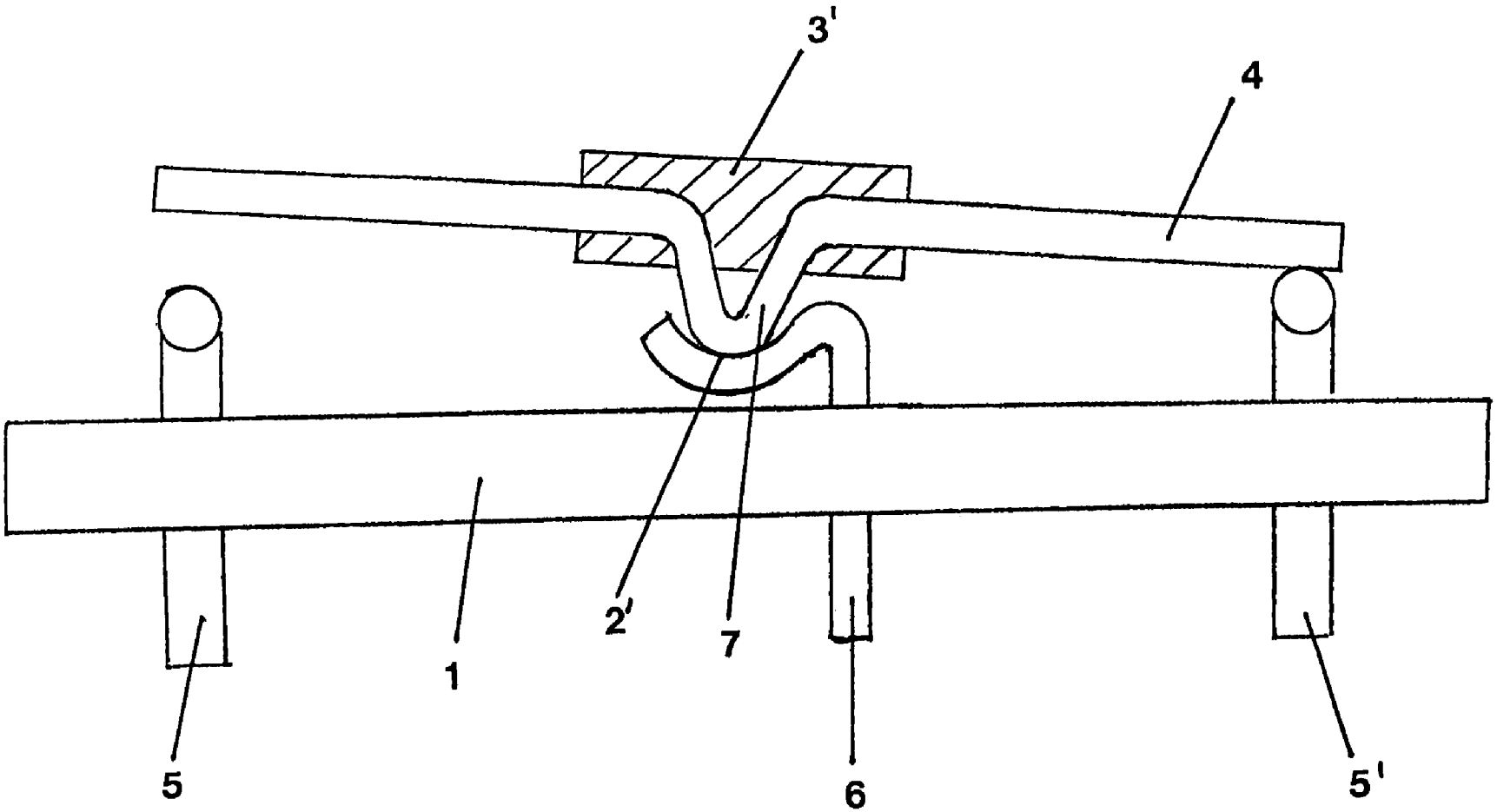
FIG. 2 is a schematic side view of a contact arrangement according to a second embodiment of the invention.

FIG. 2 shows another embodiment of the invention. Here, in contrast to the embodiment shown in FIG. 1, the intermediate contact 6 is simultaneously formed as the bearing 2' for the contact bodies 4. The contact bodies 4 are bent for this purpose in their central portion, such that they form the shape of a point 7 outwardly from their generally longitudinal axis, and are supported in the bearing 2'. The central portion of the contact bodies 4 is dimensionally stabilized by a plastic body 3'. The contact between the intermediate contact 6 and contact bodies 4 occurs by direct contact of the two parts with each other. The positional security of the contact body 4 is realized by guiding the plastic body 3' with guide elements analogous to FIG. 1*a*.

Figure 3A:
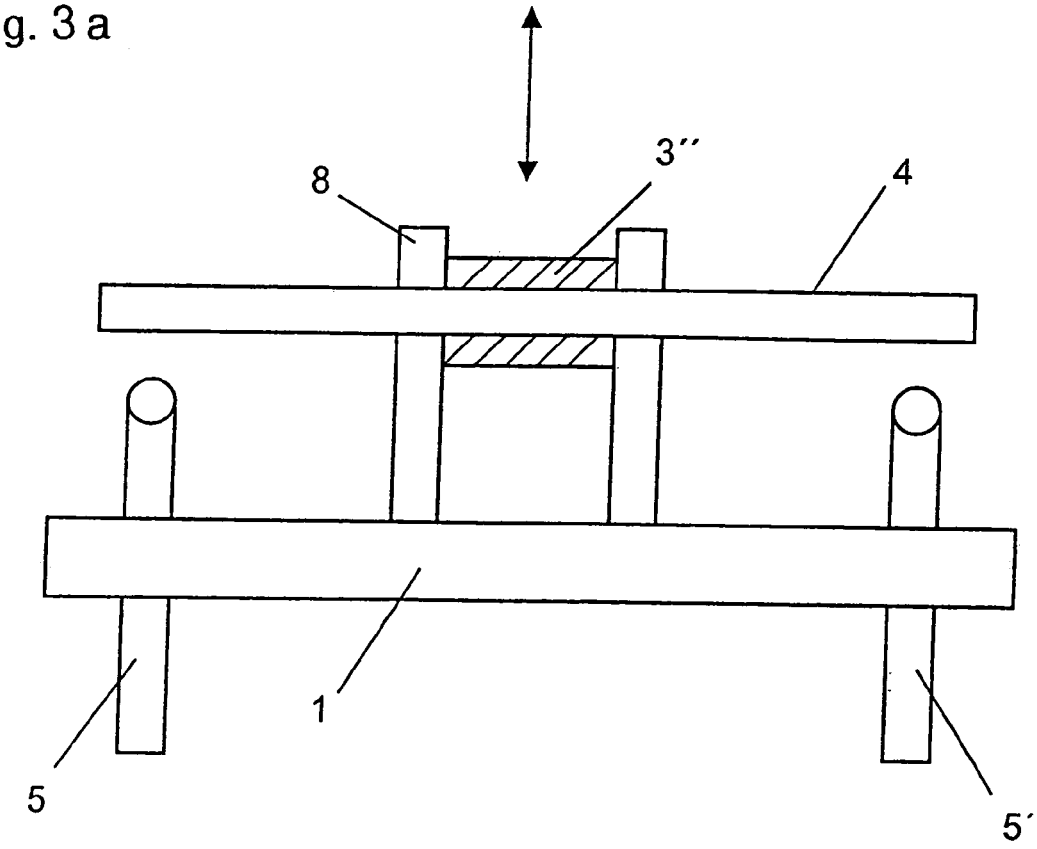
FIG. 3*a* is a schematic side view of a configuration of the invention as a bridge contact/opener.
Figure 3B:
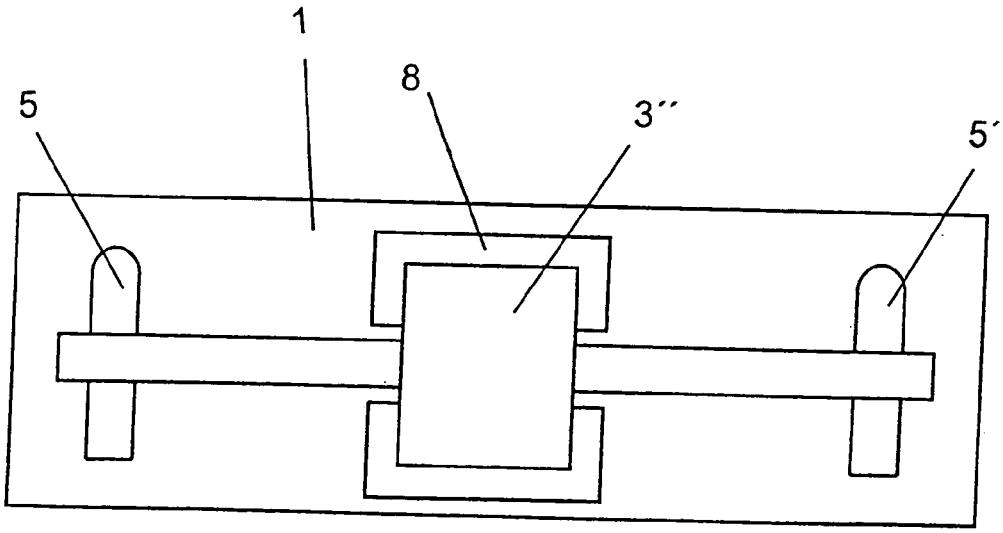
FIG. 3*b* is a top view of the configuration in FIG. 3*a;*

In FIGS. 3*a* and 3*b* another embodiment of the invention is shown, in which the counter contact bodies 5; 5' are fixed in a base body 1. Guide elements 8 are arranged on the base body 1. The guide elements are formed as two U-shaped parts, which are directed towards each other and which have a space between them (see FIG. 3*b*). There, a plastic body 3" is guided, which surrounds a contact body 4 approximately at the middle. The plastic body 3" with the contact body 4 is moved in the direction of the arrow (FIG. 3*a*) and thereby opens or closes the contacts. A plan view of the contact arrangement is shown in FIG. 3*b*.

Figure 4A:
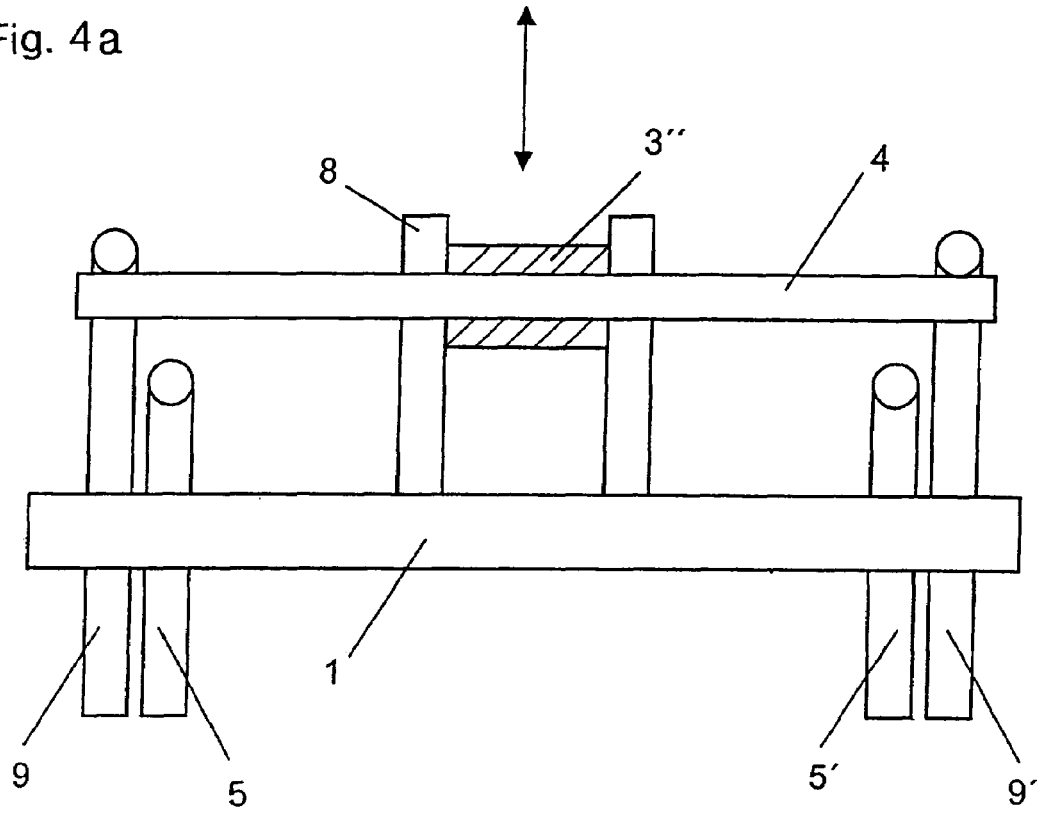
FIG. 4*a* is a schematic side view of a configuration of the invention as a bridge contact/change-over switch.
Figure 4B:
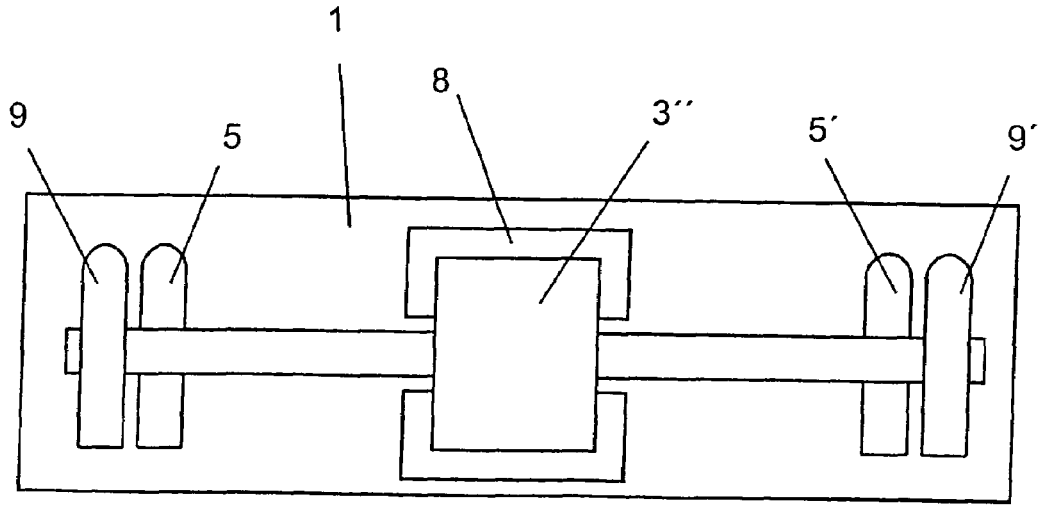
FIG. 4*b* is a top view of the configuration in FIG. 4*a;*

FIGS. 4*a* and 4*b* illustrate an embodiment of the contact arrangement similar to FIG. 3. While the counter contact bodies 5; 5' are arranged underneath the contact body 4, FIGS. 4*a* and 4*b* also show other counter contact bodies 9; 9' arranged above the contact body 4. With the arrangement of the two pairs of counter contact bodies 5; 5' and 9; 9', the path of the contact body 4 is limited on both sides, so that the arrangement has a change-over function.

Figure 5:
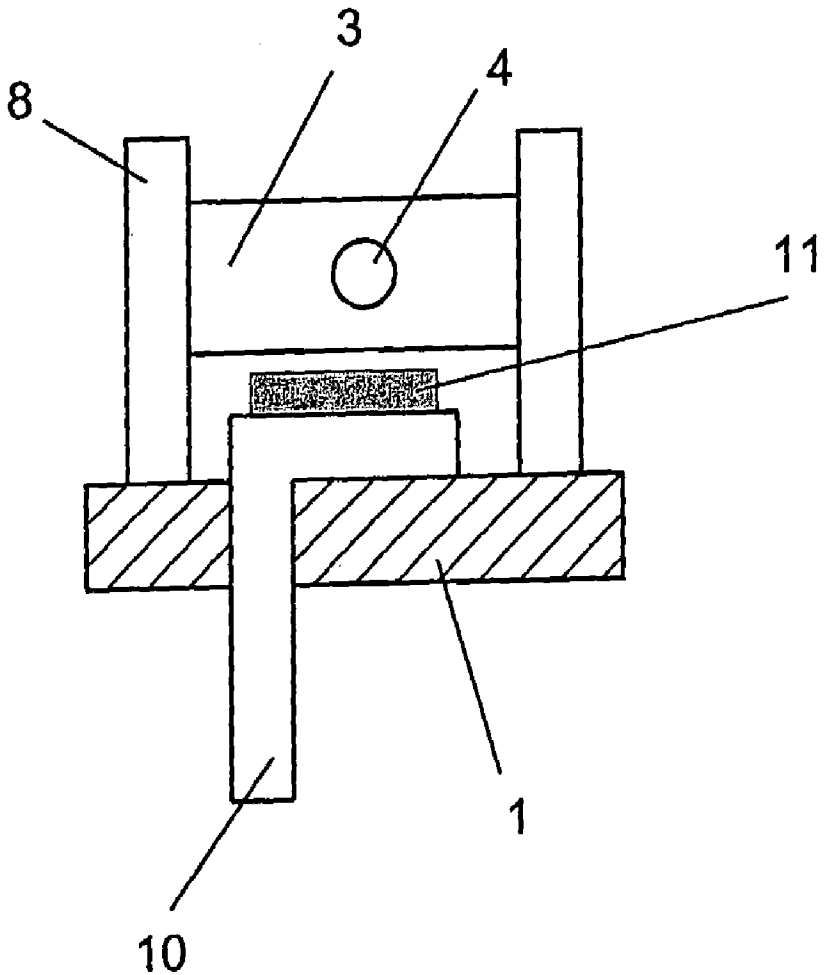
FIG. 5 is a schematic end view of a contact arrangement with special counter contact according to another embodiment of the invention.

In FIG. 5 the counter contact body 10 is formed of a bent, stamped sheet with a welded-on contact piece 11. For the rest, the arrangement essentially corresponds to the representation shown in FIG. 1*a*.

Figure 6A:
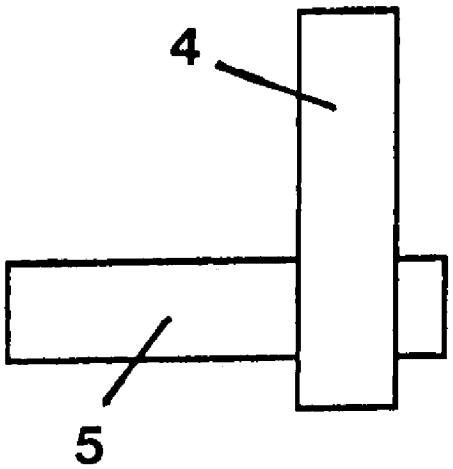
FIG. 6*a* shows schematic side and top views of contact points in a different configuration.
Figure 6A:
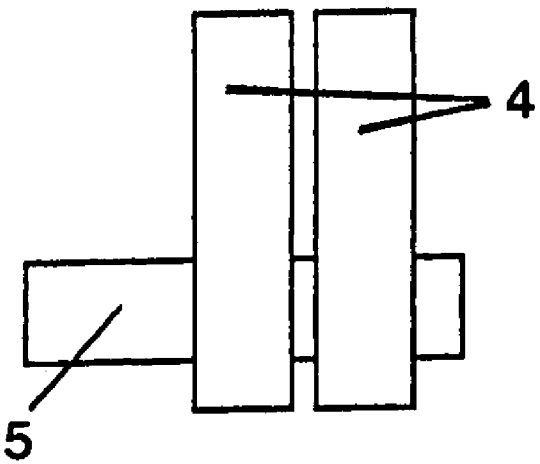
Figure 6A:
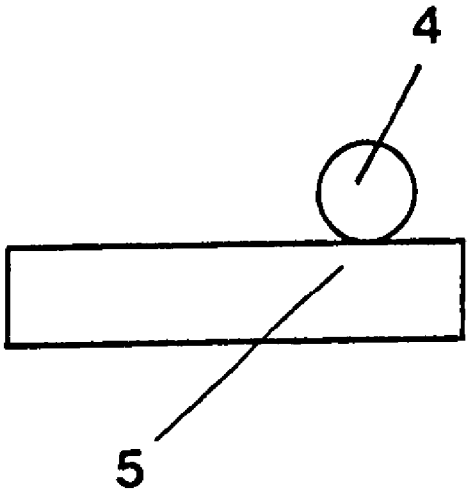
Figure 6B:
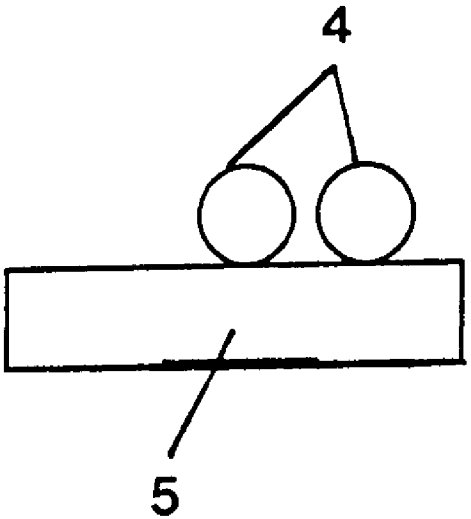
FIG. 6*b* shows schematic side and top views of contact points in another configuration.

FIGS. 6*a* and 6*b* show the principle of an arrangement of the contact points in crossed arrangement of the contact body(ies) 4 and the counter contact body 5. Here, in FIG. 6*b*, two contact bodies 4 cross one counter contact body 5. Instead of two contact bodies 4, a profiled wire can also be used, which generates more than one contact point. Likewise, instead of a single counter contact body 5, it is possible to arrange several counter contact bodies 5 in parallel.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A contact arrangement comprising at least one contact body having a substrate and a contact layer, and at least one counter contact body, wherein the substrate has a form of a wire, the contact layer being arranged directly on the wire, and the at least one counter contact body has a form of a wire or a sheet, wherein the contact body is arranged on a base body by a rocker arranged so that it can move on a bearing, and wherein the at least one counter contact body is arranged stationary to the bearing.

2. The contact arrangement according to claim 1, wherein the at least one counter contact body and the at least one contact body comprise a same material.

3. The contact arrangement according to claim 1, wherein the wire has a form of a wrapped wire.

4. The contact arrangement according to claim 1, wherein the wire has a form of spring wire.

5. The contact arrangement according to claim 1, wherein the contact layer comprises gold and at least one metal selected from the group consisting of ruthenium, tungsten, cobalt, and nickel.

6. The contact arrangement according to claim 1, wherein the contact layer is sputtered or electroplated.

7. The contact arrangement according to claim 1, wherein the at least one counter contact body is arranged on the base body.

8. The contact arrangement according to claim 1, comprising two counter contact bodies.

9. The contact arrangement according to claim 1, wherein the arrangement comprises a high-frequency switching device.

10. The contact arrangement according to claim 1, wherein the at least one contact body comprises a plurality of wires, and the wires are arranged parallel to each other.

11. The contact arrangement according to claim 10, wherein the at least one contact body comprises about 2 to 20 wires.

12. The contact arrangement according to claim 1, wherein the rocker comprises plastic, and the rocker encloses the wires of the at least one contact body in a portion of its length.

13. The contact arrangement according to claim 12, wherein the rocker encloses the wires of the at least one contact body in their central region.

14. The contact arrangement according to claim 1, wherein the at least one counter contact body comprises a sheet.

15. The contact arrangement according to claim 14, wherein the sheet is stamped and has a contact material arranged thereon.

16. A contact arrangement comprising at least one contact body having a substrate and a contact layer, and at least one counter contact body, wherein the substrate has a form of a wire, the contact layer is arranged directly on the wire, and the at least one counter contact body has a form of a wire, wherein the arrangement has two counter contact bodies.

17. The contact arrangement according to claim 16, wherein the at least one contact body is arranged so that it can move in parallel and has an approximately equal spacing from each counter contact body.

18. The contact arrangement according to claim 16, wherein the contact bodies are arranged on a base body by a rocker arranged to move on a bearing.

* * * * *